US008604682B2

(12) United States Patent
Bauer et al.

(10) Patent No.: US 8,604,682 B2
(45) Date of Patent: Dec. 10, 2013

(54) BUILT-IN LAMP WITH CABLE, IN PARTICULAR FOR AERODROME LIGHTING

(75) Inventors: Josef Bauer, Walting (DE); Hans-Hermann Gmeiner, Ingolstadt (DE); Silvia Hangl, Nürnberg (DE); Johann Holland, Schernfeld (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 418 days.

(21) Appl. No.: 12/738,816

(22) PCT Filed: Oct. 18, 2007

(86) PCT No.: PCT/EP2007/061128

§ 371 (c)(1),
(2), (4) Date: Apr. 19, 2010

(87) PCT Pub. No.: WO2009/052851

PCT Pub. Date: Apr. 30, 2009

(65) Prior Publication Data

US 2010/0244654 A1 Sep. 30, 2010

(51) Int. Cl.
*H01J 5/62* (2006.01)
*H01J 9/24* (2006.01)

(52) U.S. Cl.
USPC ..... 313/318.12; 445/23

(58) Field of Classification Search
USPC ..... 313/318.12, 579; 362/145, 153.1, 470, 362/559; 439/611; 445/23
See application file for complete search history.

(56) References Cited

U.S. PATENT DOCUMENTS

| | | | | |
|---|---|---|---|---|
| 2,680,236 | A | 6/1954 | Kuebler | |
| 3,848,120 | A * | 11/1974 | Wolfe et al. | 362/549 |
| 3,946,263 | A * | 3/1976 | Protzeller | 313/312 |
| 4,145,630 | A * | 3/1979 | DeCaro et al. | 313/273 |
| 4,151,364 | A * | 4/1979 | Ellis | 174/84 C |
| 4,608,624 | A | 8/1986 | Blaisdell et al. | |
| 4,864,183 | A * | 9/1989 | Okano | 313/318.1 |
| 5,165,789 | A | 11/1992 | Womack | |
| 6,210,029 | B1 | 4/2001 | Noll et al. | |
| 2006/0199446 | A1 | 9/2006 | Wilson | |
| 2007/0164649 | A1 * | 7/2007 | Knorr | 313/318.01 |

FOREIGN PATENT DOCUMENTS

| | | |
|---|---|---|
| DE | 198 42 794 | 3/2000 |
| DE | 299 18 862 | 3/2000 |
| DE | 10 2004 006 439 | 8/2005 |

(Continued)

OTHER PUBLICATIONS

German Translation of an Office Action issued on Jun. 28, 2012 in the corresponding Japanese Patent Application No. 2010-529237.

*Primary Examiner* — Nimeshkumar Patel
*Assistant Examiner* — Steven Horikoshi
(74) *Attorney, Agent, or Firm* — Cozen O'Connor

(57) ABSTRACT

A lamp which has a lamp glass envelope (14) having contact pins (16) projecting from its end (15) and which is held in a socket receptacle (9) having an insulator (2, 6), wherein the insulator (2, 6) holds a small metallic tube (1) between a contact pin (16) of the lamp envelope (14) and a current-feeding connecting cable (4) in at least one through hole, to which small tube (1) the contact pin (16) is crimped and the connecting cable (4) is connected.

13 Claims, 6 Drawing Sheets

(56) References Cited

FOREIGN PATENT DOCUMENTS

| | | |
|---|---|---|
| JP | 63-237369 | 10/1988 |
| JP | 01-243366 | 9/1989 |
| JP | 05-054867 | 3/1993 |
| JP | 07-192705 | 7/1995 |
| JP | 2007-523452 | 8/2007 |
| WO | WO 2005/076317 | 8/2005 |

* cited by examiner

BUILT-IN LAMP WITH CABLE, IN PARTICULAR FOR AERODROME LIGHTING

RELATED APPLICATIONS

This is a U.S. national stage of application No. PCT/EP2007/061128, filed on Oct. 18, 2007.

FIELD OF THE INVENTION

The invention relates to a lamp having an attached cable, in particular for installation in a reflector housing for the lighting and marking of aircraft taxiways.

BACKGROUND OF THE INVENTION

For the lighting and marking of aircraft taxiways light sources are required which have a low mounting height and emit a beam of rays, as parallel as possible as a general rule, in a predefined direction. On account of the comparatively small glass envelope, a long service life and a high light yield, halogen incandescent lamps are preferably employed in this situation, the light from which is focused by means of a reflector and radiated directionally. It is however also conceivable to employ high-pressure discharge lamps. For the sake of simplicity, halogen incandescent lamps with a spiral-wound filament are assumed in the following, whereby high-pressure discharge lamps with an electric arc should however also be included.

A precise positioning of the light source, in other words of the filament or the arc, within the reflector environment is necessary for focusing the light. Production tolerances in the manufacture of the lamp glass envelope would require a complex readjustment following installation of the lamp in order to achieve precise positioning at the focal point of the reflector environment. In order to avoid this problem, the base of each individual lamp glass envelope is actually adjusted to the eventual focus position in the reflector during the assembly of the lamp. In the case of a defective lamp, the entire module comprising glass envelope and base is replaced and no readjustment is needed. For this so-called "airfield" sector, special halogen incandescent lamps (and in terms of this invention also high-pressure discharge lamps) are therefore employed, wherein electrical connecting cables are incidentally connected to contact pins led out of the actual lamp glass envelope. In addition, the invention is however also directed at lamps of comparable construction for other fields of application, whether it be for fitting in reflector housings also preferably coming into consideration outside the airfield sector, or whether it also be independent thereof.

SUMMARY OF THE INVENTION

One object of the present invention is to provide an improved lamp of the type described and a corresponding manufacturing method.

One aspect of the invention is directed to a lamp which has a lamp glass envelope having contact pins projecting from its end and which is held in a socket receptacle having an insulator. The insulator holds a small metallic tube between a contact pin of the lamp envelope and a current-feeding connecting cable in at least one through hole, with which small tube the contact pin is crimped and the connecting cable is connected.

Another aspect of the invention is directed to a method for manufacturing a lamp, wherein a lamp glass envelope having contact pins projecting from its end is held in a socket receptacle having an insulator, and wherein at least one contact pin is crimped to a metallic small tube, which small tube is connected with a current-feeding connecting cable and is held in a through hole in the insulator.

The inventors have recognized that lamps having an attached cable can be manufactured particularly easily and reliably by crimping in the base. In comparison with welded or soldered connections, crimped connections can be implemented without heating and checking melting metals, and thus more simply and cost-effectively. It is also possible to make a crimped connection of contact pins to connecting cables by means of at least one small metal tube. The at least one small metal tube is crimped on the glass envelope side to the corresponding contact pin and connected on the opposite side to a current-feeding cable. The cable can for example be welded, soldered or, particularly advantageously, likewise crimped to the small tube.

It is also advantageous to implement the additional component required for crimping as a small tube because glass envelope and cable can already be held provisionally in the final position by simply pushing together with the contact pin and then only need to be crimped in order to produce a permanent connection. The shape of a small tube is also suitable for crimping.

The term "small tube" is to be understood as follows from this context: It does not necessarily need to be a small tube completely closed in the circumferential direction. A remaining slot would not have a detrimental effect as long as the contact pin can be inserted and retained. It can also be sufficient to provide a cross-sectional profile of the small tube suitable for inserting and retaining the contact pin only in some places along its axial length. In this situation, a simple small tube having a circular ring cross-section remaining the same over the axial length is particularly preferred.

In order to supply power to the spiral-wound filament in the interior of the lamp glass envelope there are two current lead-throughs in the end of the glass envelope, which end on the one hand seals off the lamp glass envelope and on the other hand holds the spiral-wound filament (or an electrode) and the power supply lines. The end of the lamp glass envelope is normally designed as a flat end, pinched glass in particular. The power supply lines, which are pin-shaped outside the pinching, then frequently have molybdenum foils inside the pinching.

The socket receptacle with the lamp glass envelope can, as known, preferably be secured in a reflector by means of a position adjustment flange. In this situation, the flange is preferably mounted in a metal sleeve, whereby the position of the flange is related to the ideal location inside the reflector of the spiral-wound filament generating the light.

At least one of the contact pins must be electrically insulated, in particular with respect to a socket receptacle having metal parts, as mentioned above for instance. The other contact pin could also be connected to the metal sleeve or other conducting surrounding parts. In the minimum case, the insulator can for example consist of a small glass or ceramic tube. By preference, the insulator is a ceramic cuboid having a through hole for receiving the contact pin and the small metal tube. More preferably, two holes exist in the ceramic cuboid for the two contact pins, such that the two contact pins are insulated from one another and from their surroundings.

With regard to the electrical connection of the connecting cable or cables to the small metal tube or tubes, provision can be made for a broadening of small tube and/or cable, such that the small tube can no longer be withdrawn from the insulator towards the lamp glass envelope. A safeguard against accidentally pulling the lamp glass envelope out of the socket receptacle can thus be achieved. A crimping also of the connecting cables in the small metal tube can preferably also be considered here.

In the case of a flat glass end, the metal sleeve preferably abuts against the flat end by means of metal lugs bent inwards. In this situation, the metal lugs may also snap into notches or behind grooves in or on the flat end and additionally fix the lamp glass envelope in the socket receptacle. From this, a particularly effective safeguard against an accidental disconnection then results. In any case, the lugs touching the pinching serve to better dissipate the heat generated in the lamp.

Because of the mostly poor thermal conductivity of the materials used as insulators it is advantageous if the metal sleeve has apertures for improved heat dissipation in the region of the insulator. These apertures are advantageously placed on the broader sides of the flat glass pinching.

The aforementioned lugs protruding into the interior of the metal sleeve can be implemented particularly simply by means of cuts in the sheet metal of the metal sleeve.

Additional apertures in the region of the lugs result in an unconstrained manner if the cuts defining the lugs are larger than the lugs themselves and encompass a contiguous area. The cuts can be made for example by using punching or cutting tools.

The insulator receiving the small metallic tubes can be constructed in two parts. For example, a first part can receive the small tubes and a second part can contain holes through which the connecting cables are fed to the small tubes. This facilitates the assembly or the connection of connecting cables and small tube and makes it possible to remove the insulation from the current-feeding cable over an extended length, for example in order to avoid damage caused by heat to the insulating coating of the cables.

The crimping of contact pin and small metal tube can also be performed even if the small tubes are already mounted in the socket receptacle. To this end, side recesses are located in the insulator in the region of the ends of the small tubes on the glass envelope side, which side recesses in conjunction with the apertures in the metal sleeve enable access for crimping after insertion of the contact pins.

If the insulator does not have these apertures, the step of crimping small tube and contact pin can also take place prior to assembly.

In the case of a two-part insulator with side accesses for crimping in the part on the glass envelope side, the following sequence can advantageously be observed when assembling the lamp: Firstly, the small metal tubes (or tube) are (is) inserted into the through hole in the first insulator part on the glass envelope side, then the connecting cables (or cable) are (is) crimped to the small tubes (or tube), whereby the cable-side small tube ends are deformed such that the small tubes are prevented from being pulled out on the glass envelope side. Subsequently, the second insulator part is pulled over the connecting cable or cables, with the result that the freestanding cable-side small tube ends are enclosed by the insulator. The totality of small tube, insulator and cables is now let into the metal sleeve, and is fixed therein on the one hand by punctiform indentation of the wall of the metal sleeve and is fixed in the metal sleeve on the other hand by folding over a corresponding projection on the sheet metal of the sleeve. Fixing of the insulator in the metal sleeve can in principle also be accomplished by other means, for example by screwing in place.

BRIEF DESCRIPTION OF THE DRAWINGS

The invention will be described in detail in the following with reference to exemplary embodiments.

FIGS. 1 - 6 in this order consequently illustrate the progress of a preferred manufacturing method and show a lamp according to an embodiment of the invention in FIG. 6.

DETAILED DESCRIPTION OF THE DRAWINGS

Figure 1:
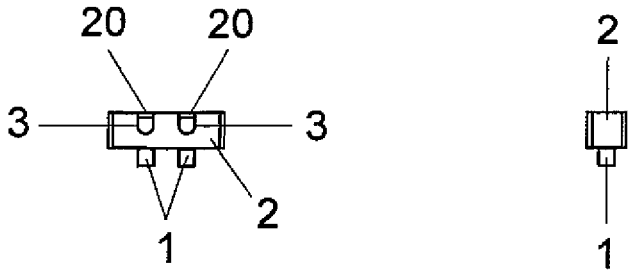
FIG. 1 shows a first insulator part having two small metallic tubes held therein.

FIG. 1 shows two small metal tubes 1 which are held in a first insulator part 2 made of ceramic. At the ends of the small tubes which in the mounted state are facing the lamp glass envelope this first insulator part 2 has recesses 3 in the material which in a later method step permit access for the crimping of the small tubes 1. At their end on the glass envelope side the small tubes 1 have a broadening 20 which safeguards the small tubes against pulling out or falling out on the cable side from the first insulator part. The extension of the first insulator part in the direction of the small tube axis is dimensioned such in this situation that a part of the small tubes sufficient for the crimping to the cables protrudes out of the insulator part if the broadening 20 of the small tubes terminates flush with the corresponding surface of the first insulator part.

Figure 2:
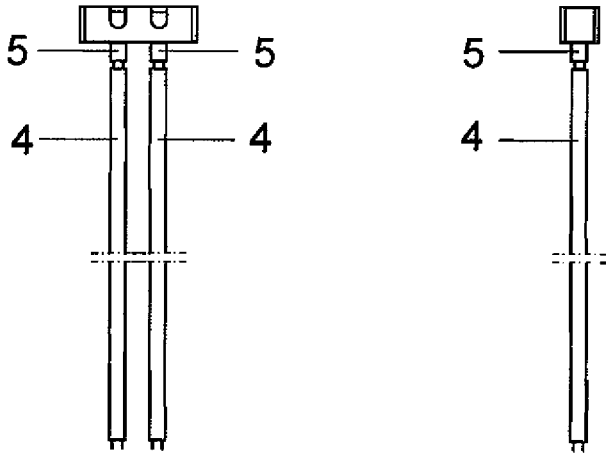
FIG. 2 shows the ensemble from FIG. 1 having connecting cables connected to the small tubes.

FIG. 2 shows the connection of two connecting cables 4 to the small tubes 1. At their ends on the small tube side the cables 4 are stripped of their insulation and crimped to the small tubes. The crimping 5 pinches the small tubes in such a way that it is no longer possible to pull out the small tubes from the first insulator part on the lamp glass envelope side (not shown). The small tubes are advantageously already held by the first insulator part, which simplifies the crimping to the cable ends.

Figure 3:
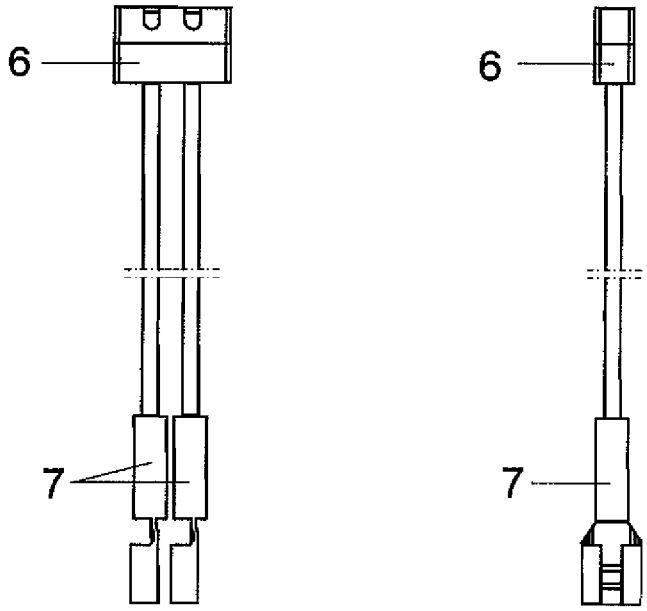
FIG. 3 shows the module from FIG. 2 having a second insulator part.

FIG. 3 shows a second insulator part 6 which attaches directly to the first insulator part 2 and completely surrounds the crimping of small tubes 1 and connecting cables 4. Also illustrated are cable shoes 7 which serve by way of example for connecting the cable ends to a power supply.

Figure 4:
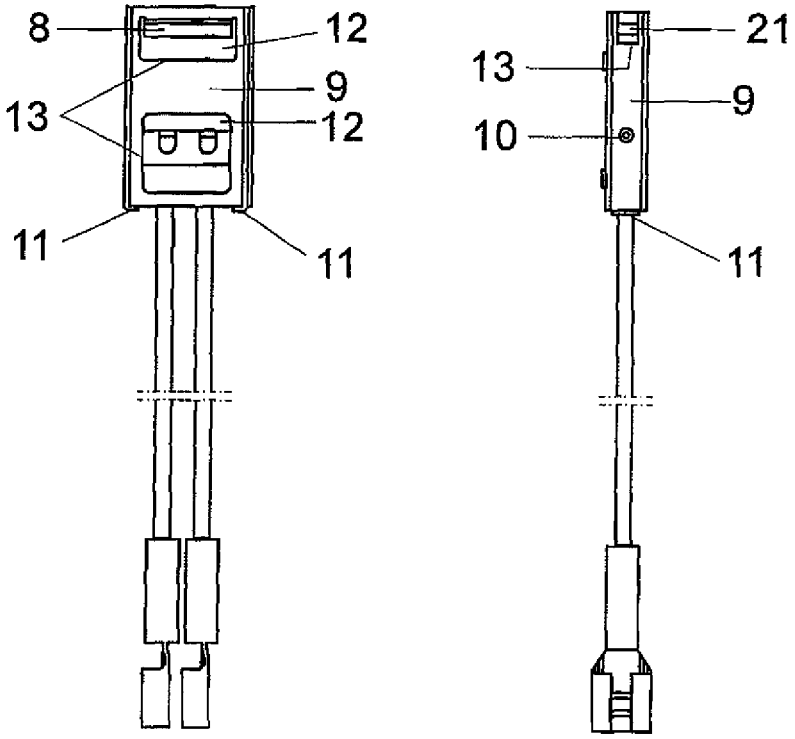
FIG. 4 shows, based on FIG. 3, the encasement of the insulator by the metal sleeve.

In FIG. 4, a metal sleeve 9 according to the invention surrounds the module comprising first insulator part, second insulator part and small metal tube. This module is fixed in the metal sleeve by means of a punctiform indentation 10 of the metal sleeve and sheet metal edges 11 bent over inwards. On its wide sides the metal sleeve has metal lugs 8 which later touch the glass pinching to provide heat dissipation and can where applicable also fix said pinching by snapping into corresponding depressions and grooves in the metal sleeve 9. The metal lug 21 on a narrow side of the metal sleeve follows the same principle. The metal lugs 8, 21 pressed against the lamp glass envelope are likewise used for improved heat dissipation. This is particularly useful on account of the fact that the high temperatures of the lamp glass envelope occurring during operation of the lamp have disadvantageous effects on the tightness of the glass seal in the region of the current-conducting contact pins and shorten the service life of the lamp which can be achieved in principle. This problem is regarded as the cause of the loss of tightness resulting from oxidation of the molybdenum foils used as current lead-through. By reason of the compact reflector construction, in particular in the case of reflectors sunk into the aircraft taxiway, and in consequence of their limited heat dissipation through convection, an improved removal of the heat transferred onto the region of the pinching is of great importance with regard to the avoidance of early failures.

Figure 4A:
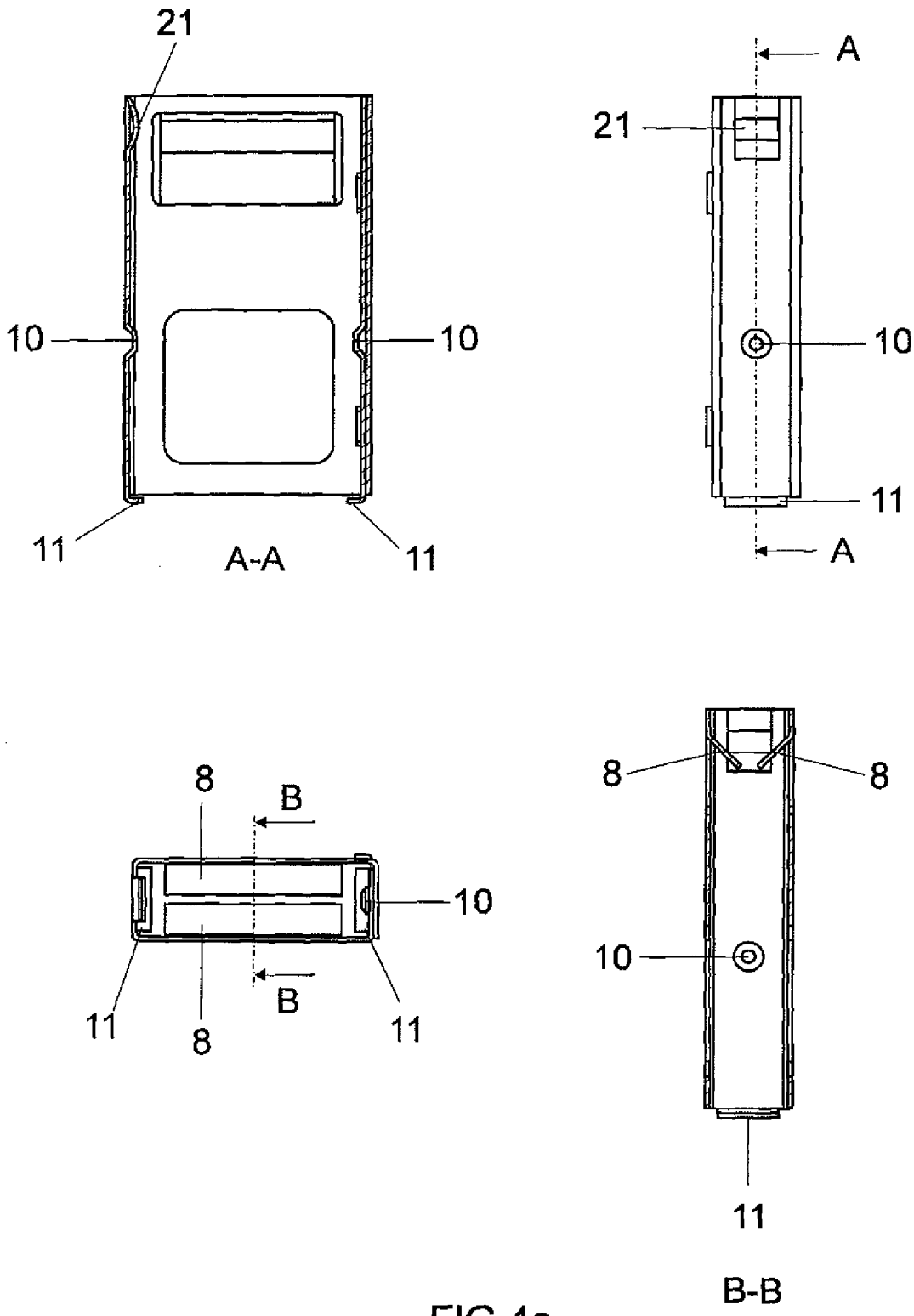
FIG. 4*a* shows cross-sections of the metal sleeve from FIG. 4.

FIG. 4*a* illustrates the implementation of the lugs 8, 21 by means of sectional representations of the metal sleeve. The punctiform indentations 10 and the sheet metal edges 11 for fixing the insulator are also represented. In the region of the insulator and the lugs 8 bent inwards are situated apertures 12 for the purpose of improved heat dissipation. Apertures and lugs are defined by cuts 13 into the metal sleeve.

Figure 5:
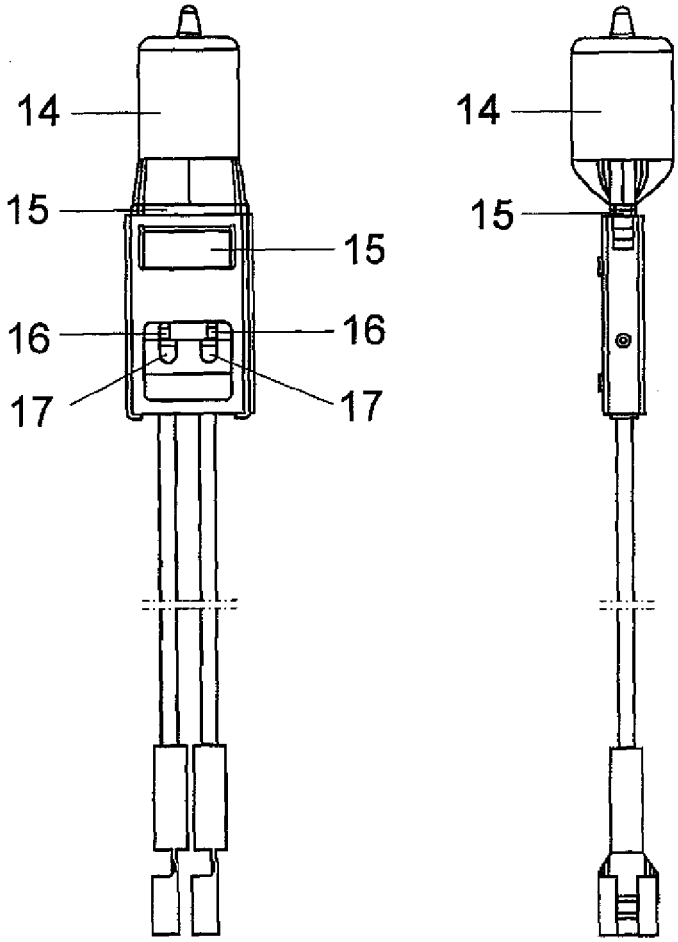
FIG. 5 shows the module from FIG. 4, whereby the metal sleeve also holds a lamp glass envelope.

FIG. 5 shows a lamp glass envelope 14 in the state in which it is built into the metal sleeve. The lamp glass envelope 14 has a wedge-base lamp socket 15, which the lugs of the metal sleeve touch as described above by pressing against it. The contact pins 16 of the lamp glass envelope 14 mate into the small metal tubes and are crimped to said small metal tubes at the points 17. Since the small tubes cannot be withdrawn on the glass envelope side by reason of the pinching of the cable-side ends associated with the crimping of the cable, the crimping 17 increases the strength of the bond of glass envelope 14 and metal sleeve and safeguards the former (additionally) against being accidentally pulled out.

Figure 6:
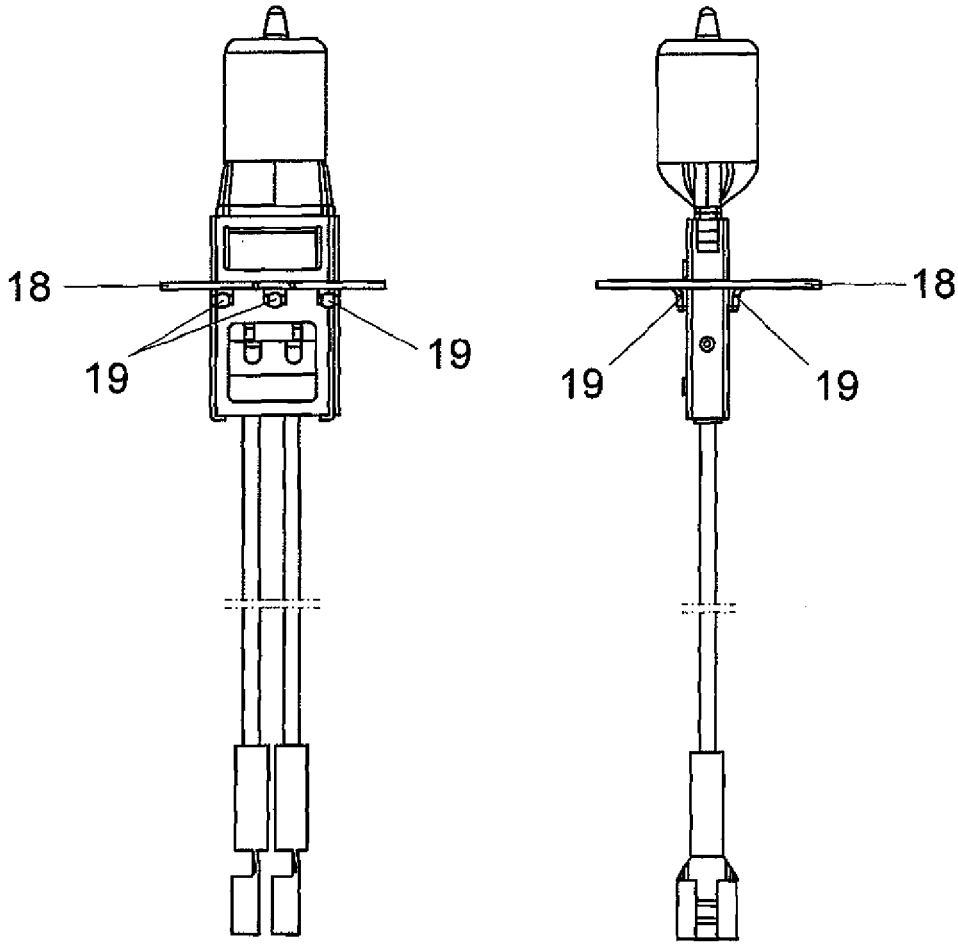
FIG. 6 shows the module from FIG. 5, to which a positioning flange has been added.

FIG. 6 shows the basic arrangement of a position adjustment flange 18 on the metal sleeve. The position adjustment flange has projections 19 which are spot welded to the metal sleeve.

The invention claimed is:

1. A lamp comprising:

a lamp glass envelope having contact pins projecting from a flat end of the lamp glass envelope;

a socket receptacle having a position adjustment flange and an insulator including lateral accesses to lamp-side small tube ends for crimping, the lamp glass envelope being held in the socket receptacle;

a metal sleeve, which is open on a lamp side, encloses the insulator and includes lateral apertures at least in a region of the insulator, and cuts into the metal sleeve defining lugs bent inwards to abut against the flat glass end of the lamp glass envelope, the cuts being larger than the lugs and forming second lateral apertures;

wherein the insulator holds a small metallic tube between one of said contact pins of the lamp glass envelope and a current-feeding connecting cable in at least one through hole, to which small metallic tube the contact pin is crimped and the current-feeding connecting cable is connected.

2. The lamp as claimed in claim 1, wherein the lamp is a halogen incandescent lamp.

3. The lamp as claimed in claim 1, wherein the insulator is constructed in several parts, and wherein each of said several parts includes at least one through hole for receiving the small metallic tube.

4. The lamp as claimed in claim 1, wherein the connecting cable is connected to the small metallic tube such that the small metallic tube is safeguarded against being pulled out on the lamp glass envelope side from the at least one through hole of the insulator.

5. The lamp as claimed in claim 1, wherein the connecting cable is crimped to the small metallic tube.

6. A method for manufacturing a lamp, wherein a lamp glass envelope having contact pins projecting from its end is held in a socket receptacle having an insulator, the method comprising:

crimping at least one contact pin to a metallic small tube which is connected with a current-feeding connecting cable and is held in a through hole in the insulator; and mounting a position adjustment flange directly after crimping the at least one contact pin to the metallic small tube, the insulator being enclosed by a metal sleeve open on a lamp side and the socket receptacle containing the position adjustment flange.

7. The method as claimed in claim 6, wherein the step of crimping at least one contact pin to the metallic small tube occurs chronologically after assembly of the insulator, the lamp glass envelope, the metal sleeve and the metallic small tube.

8. The method as claimed in claim 6, wherein assembly of the insulator and the metallic small tube occurs prior to their fitting into the metal sleeve.

9. The method as claimed in claim 6, wherein the connection of the metallic small tube and the current-feeding connecting cable occurs prior to their fitting into the metal sleeve.

10. The method as claimed in claim 6, wherein the metallic small tube and the current-feeding connecting cable are connected to one another after assembly of the metallic small tube and the insulator.

11. The method as claimed in claim 6, further comprising the following steps in the following order: fitting the metallic small tube into a first part of the insulator, connecting the connecting cable to the metallic small tube, mounting a second part of the insulator, fitting the insulator into the metal sleeve, inserting the lamp glass envelope into the metal sleeve, crimping the contact pin and the metallic small tube, and mounting the position adjustment flange.

12. The method as claimed in claim 6, wherein the current-feeding connecting cable and the metallic small tube are connected together by crimping such that the metallic small tube is safeguarded against being pulled out from the insulator on the lamp side by pinching of a cable-side metallic small tube end occurring during the crimping.

13. A method for manufacturing a lamp, wherein a lamp glass envelope having contact pins projecting from its end is held in a socket receptacle having an insulator, the method comprising the following steps in the following order:

fitting a metallic small tube into a first part of the insulator;

connecting a current-feeding connecting cable to the metallic small tube;

mounting a second part of the insulator;

fitting the insulator into a metal sleeve;

inserting the lamp glass envelope into the metal sleeve;

crimping at least one contact pin of the contact pins to the metallic small tube which is connected with the current-feeding connecting cable and is held in a through hole in the insulator; and mounting the position adjustment flange.

* * * * *